US006591794B2

(12) United States Patent
Toda

(10) Patent No.: US 6,591,794 B2
(45) Date of Patent: Jul. 15, 2003

(54) AIR-FUEL RATIO CONTROL SYSTEM FOR A STRATIFIED SCAVENGING TWO-CYCLE ENGINE

(75) Inventor: Mamoru Toda, Iwate-ken (JP)

(73) Assignee: Zama Japan (JP)

( * ) Notice: Subject to any disclaimer, the term of this patent is extended or adjusted under 35 U.S.C. 154(b) by 0 days.

(21) Appl. No.: 10/097,107

(22) Filed: Mar. 12, 2002

(65) Prior Publication Data

US 2002/0117130 A1 Aug. 29, 2002

Related U.S. Application Data

(63) Continuation of application No. 09/696,630, filed on Oct. 24, 2000, now Pat. No. 6,354,251.

(51) Int. Cl.[7] ..... F02B 33/04
(52) U.S. Cl. ..... 123/73 A
(58) Field of Search ..... 123/73 A, 73 PD, 123/65 A, 65 P, 74 A, 73 AA, 73 D; 261/35

(56) References Cited

U.S. PATENT DOCUMENTS

| | | | | |
|---|---|---|---|---|
| 1,722,951 A | * | 7/1929 | Barkeij | 123/73 A |
| 2,317,772 A | | 4/1943 | Huber et al. | |
| 2,325,010 A | | 7/1943 | McCurdy | |
| 2,481,901 A | * | 9/1949 | Bracke | 123/73 D |
| 2,981,279 A | | 4/1961 | Beck | |
| 3,174,469 A | | 3/1965 | Rappolt | |
| 3,439,658 A | | 4/1969 | Simonet | |
| 4,060,062 A | | 11/1977 | Tsutsui et al. | |
| 4,073,278 A | | 2/1978 | Glenn | |
| 4,075,985 A | | 2/1978 | Iwai | |
| 4,094,931 A | | 6/1978 | Karino | |
| 4,182,295 A | | 1/1980 | Zeller et al. | |
| 4,200,083 A | | 4/1980 | Ishida | |
| 4,256,063 A | | 3/1981 | Sumiyoshi et al. | |
| 4,294,205 A | | 10/1981 | Iiyama et al. | |

(List continued on next page.)

FOREIGN PATENT DOCUMENTS

| | | | | |
|---|---|---|---|---|
| DE | 342274 | | 10/1921 | |
| DE | 432953 | | 8/1926 | |
| DE | 2 204 192 | | 8/1973 | |
| DE | 29 09 637 | | 10/1979 | |
| DE | 37 22 424 | A1 | 1/1988 | |
| DE | 19918719 | A1 * | 4/1999 | 261/35 |
| EP | 0 651 142 | A2 | 5/1995 | |
| JP | 57-183520 | | 11/1982 | |
| JP | 9-268918 | | 10/1997 | |
| WO | WO98/17902 | | 4/1998 | |

*Primary Examiner*—Marguerite McMahon
(74) *Attorney, Agent, or Firm*—Orrick, Herrington & Sutcliffe LLP

(57) ABSTRACT

An air-fuel ratio control system for a stratified scavenging two-cycle engine that facilitates the elimination of acceleration failure in the initial stage of acceleration due to the dilution of the air-fuel mixture when scavenging air is introduced. In a preferred embodiment, the control system includes a driving gear and a driven gear that are connected to a carburetor throttling valve for controlling output and an air valve for controlling the flow rate of the scavenging air, respectively. Improved acceleration is achieved by not increasing the amount of air relative to the increasing amount of air-fuel mixture initially being introduced by not engaging the gears until the throttling valve opens slightly from the idling position. When the throttling valve is wide open, the two gears engage with each other, thereby opening the air valve and maintaining a nearly constant flow rate ratio between the air-fuel mixture and the air. Alternatively, the control system may include a driving lever and a driven lever that are connected to a carburetor throttling valve and an air valve for controlling the flow rate of the air-fuel mixture and the scavenging air, respectively.

14 Claims, 3 Drawing Sheets

U.S. PATENT DOCUMENTS

| | | | | |
|---|---|---|---|---|
| 4,333,429 | A | | 6/1982 | Iiyama et al. |
| 4,796,579 | A | | 1/1989 | Wolfe et al. |
| 4,861,522 | A | | 8/1989 | Gerhardy et al. |
| 4,903,655 | A | | 2/1990 | Vonderau et al. |
| 4,936,267 | A | | 6/1990 | Gerhardy et al. |
| 4,944,272 | A | | 7/1990 | Carlsson et al. |
| 5,036,816 | A | | 8/1991 | Mann |
| 5,200,118 | A | | 4/1993 | Hermle |
| 5,283,013 | A | | 2/1994 | Gerhardy |
| 5,379,732 | A | * | 1/1995 | Mavinahally et al. ... 123/73 AA |
| 5,681,508 | A | | 10/1997 | Gerhardy |
| 5,743,240 | A | | 4/1998 | Zerrer et al. |
| 6,000,683 | A | | 12/1999 | Van Allen |
| 6,123,322 | A | | 9/2000 | Sasaki |
| 6,135,072 | A | | 10/2000 | Kishita ..... 123/73 A |
| 6,328,288 | B1 | | 12/2001 | Gerhardy |
| 6,347,787 | B1 | | 2/2002 | Tobinai et al. |
| 6,354,251 | B1 | * | 3/2002 | Toda ..... 123/73 A |

* cited by examiner

AIR-FUEL RATIO CONTROL SYSTEM FOR A STRATIFIED SCAVENGING TWO-CYCLE ENGINE

RELATED APPLICATION DATA

This application is a continuation of application Ser. No. 09/696,630, filed Oct. 24, 2000, now U.S. Pat. No. 6,354,251.

FIELD OF THE INVENTION

The present invention relates to an air-fuel ratio control system for a stratified scavenging two-cycle engine and, more particularly, to a crankcase compression-scavenging method that exhausts the combustion gas by introducing air into the combustion chamber during scavenging and then introduces an air-fuel mixture into the combustion chamber.

BACKGROUND OF THE INVENTION

In two-cycle engines, as the ignition and explosion of an air-fuel mixture pushes the piston down, an exhaust port opens to begin exhausting the combustion gas. Any remaining combustion gas is exhausted when a scavenging port opens to introduce the air-fuel mixture supplied to the crankcase into the combustion chamber. In certain two-cycle engines, an air passage is connected to the scavenging passage that links the crankcase to the combustion chamber such that the combustion gas is exhausted by first introducing air from the air passage into the combustion chamber when the scavenging port opens and then introducing the air-fuel mixture from the crankcase.

Examples of two-cycle engines that perform stratified scavenging are described in Japanese patent application numbers H9-125966 and H9-287521. These patent applications describe scavenging systems that includes a throttling valve for output control provided in the air-fuel mixture passage and an air valve for flow control provided in the air passage. The throttling and air valves are interlocked by means of a linking mechanism. These engines are designed to eliminate the problem of incomplete combustion and misfiring that are caused by the introduction of a large amount of residual combustion gas into the air-fuel mixture by introducing air into the combustion chamber. These engines are also designed to eliminate the problem of engine performance loss, which is caused by large fluctuations in the flow rate ratio between the air-fuel mixture and the air, by opening and closing the throttling valve and the air valve in an interlocked manner.

Among the machines that use the aforementioned two-cycle engine as the power source, those such as hand-held portable trimmers in particular, are normally operated with the throttling valve opened halfway or fully open from the idling position. However, when they are started, or when an operation is temporarily halted, such as when the operator takes a break or when the machine is moved to another location, the throttling valve, which has returned to the idling position, must be halfway or fully opened again. The throttling valve is opened by the operator pulling a trigger near his hand, and it is closed by the force of the throttling valve return spring. Most operators pull the trigger hard, thereby opening the throttling valve to the halfway or fully open position in a single motion, which abruptly increases the engine revolution speed. This abrupt acceleration tends to occur every time work begins.

When accelerating the engine from the idle revolution region, the fuel supply is increased in correspondence with the rapidly increasing amount of air intake caused by the rapid opening of the throttling valve. The fuel supply is also increased appropriately in the initial stage of acceleration, in which the throttling valve has not opened much, in order to prevent acceleration failure. However, in an engine that prevents the air-fuel mixture from becoming diluted with air by linking the aforementioned throttling valve and the air valve by means of a linking mechanism, the air valve simultaneously begins to open when the throttling valve begins to open from the idling position. Consequently, the problem of acceleration failure, which occurs when the air-fuel mixture required for acceleration becomes diluted, cannot be avoided.

The present invention has been developed in order to solve the aforementioned problem of acceleration performance loss that is inherent in the aforementioned conventional engines that use a linking mechanism for the air-fuel ratio control system. The linking mechanism controls the throttling valve and the air valve in an interlocking manner to maintain the flow rate ratio between the air-fuel mixture and the air to be introduced into the combustion chamber, i.e., the air-fuel ratio, at a nearly constant level. Thus, it would be desirable to provide an air-fuel ratio control system that does not result in acceleration failure, especially acceleration failure that tends to occur in the initial stage of acceleration.

SUMMARY OF THE INVENTION

In order to solve the aforementioned problem, the present invention provides, as described below, an air-fuel ratio control system that tends to maintain at a nearly constant level, the flow rate ratio between the air-fuel mixture and the air that is introduced into the combustion chamber of a stratified scavenging two-cycle engine in which an air-fuel mixture passage having a throttling valve for controlling output is connected to the crankcase, and in which an air passage having an air valve for controlling flow rate is connected to the scavenging passage that connects the crankcase to the combustion chamber.

In a first innovative aspect of the present invention, the throttling valve and the air valve may be interlocked by means of gears that are individually coupled to these valves. The gears are designed to not engage with each other when the throttling valve is located between the idling position and the slightly open position, but are designed to engage with each other when the throttling valve is opened beyond the slightly open position, such that the air valve opens and closes in conjunction with the opening and closing of the throttling valve.

In a second innovative aspect of the present invention, the throttling valve and the air valve are interlocked by means of levers that are individually coupled to these valves. The levers are designed to not engage with each other when the throttling valve is located between the idling position and the slightly open position, but are designed to engage with each other when the throttling valve is opened beyond the slightly open position, such that the air valve opens and closes in conjunction with the opening and closing of the throttling valve.

With this design, when the throttling valve is opened rapidly from the idling position, the amount of air does not increase in the initial stage, thereby preventing acceleration failure due to the dilution of the air-fuel mixture. When the throttling valve is opened beyond the slightly open position, the air valve opens and closes in conjunction with the throttling valve, thus eliminating the problems of incomplete combustion and misfiring that are caused by a large amount of residual combustion gas. Engine performance is also maintained by keeping the air-fuel ratio nearly constant, in a manner that engines are intended to function.

In the first innovative aspect of the present invention, which preferably uses gears, the throttling valve rotation angle between the time at which the throttling valve begins to open and the time at which the air valve begins to open, i.e., the delay angle, can be arbitrarily set by adjusting the number of teeth on the driving gear on the throttling valve side and the number of teeth on the driven gear on the air valve side, the number of missing teeth on the gears, or the installation angles of the valve shafts. The change in the opening of the air valve in response to the change in the opening of the throttling valve can also be arbitrarily set by adjusting the speed ratio of the gears, i.e., the gear ratio or the radial ratio of the pitch circles between the gears.

In the second innovative aspect of the present invention, which preferably uses levers, the levers can be installed in any desired manner by adjusting the shape of the driving lever on the throttling valve side and the shape of the driven lever on the air valve side, as well as the installation angles of the valve shafts. The change in the opening of the air valve in response to the change in the opening of the throttling valve can also be arbitrarily set based on the lever ratio.

Note that when the gears are not engaged with each other or when the levers are not engaged with each other, it is desirable to have a return spring bias the air valve in the valve-closing direction in order to keep it fixed in the closed position. It is also desirable to have the throttling valve and the air valve supported by an integrated body in order to prevent errors in gear or lever installation from adversely affecting engine performance.

Other objects and features of the present invention will become apparent from consideration of the following description taken in conjunction with the accompanying drawings.

DETAILED DESCRIPTION OF THE PREFERRED EMBODIMENT

Figure 1:
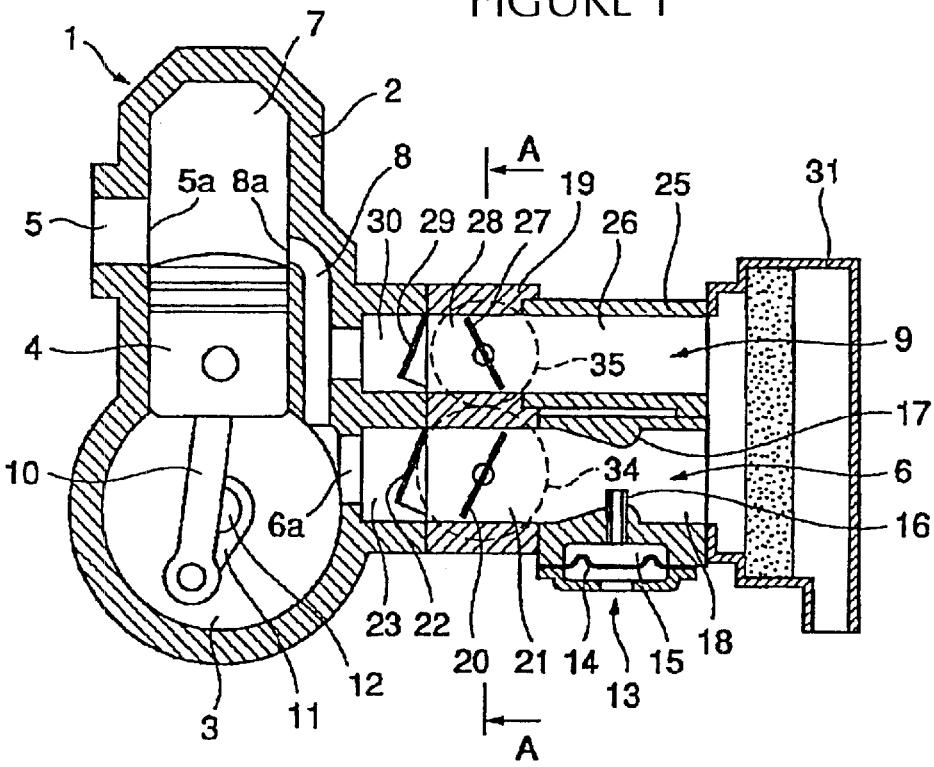
FIG. 1 is a vertical cross section showing a first embodiment of the present invention.
Figure 4:
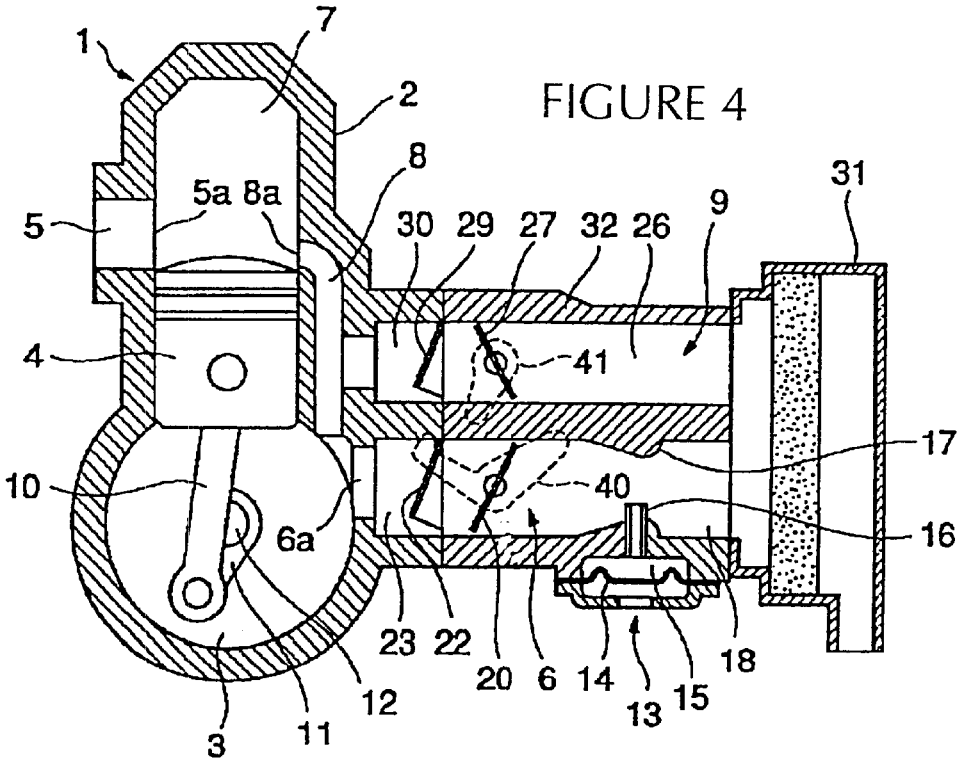
FIG. 4 is a vertical cross section showing a second embodiment of the present invention.

The preferred embodiments of the present invention will be explained with reference to the figures. In FIGS. 1 and 4, an engine 1 has a cylinder 2, a crankcase 3, and a piston 4. An exhaust port 5*a*, which provides an entrance to an exhaust passage 5, is provided in the cylinder 2. An intake port 6*a*, which provides an outlet for an air-fuel mixture passage 6, is provided in the crankcase 3. A scavenging passage 8 is also provided, which connects the crankcase 3 to a combustion chamber 7 formed in a region above the piston 4 in the cylinder 2. Additionally, an air passage 9 is connected to the scavenging passage 8.

When the piston 4 begins to ascend from the bottom dead point, the pressure inside the crankcase 3 decreases as the volume increases, and at the same time the piston 4 closes the exhaust port 5*a* and scavenging the port 8*a* provided in the wall of the cylinder 2. Consequently, the pressure inside the crankcase 3 and the scavenging passage 8 decreases, causing an air-fuel mixture to be sucked into the crankcase 3 from the air-fuel mixture passage 6. At the same time air is sucked into the scavenging passage 8 from the air passage 9, and into the crankcase 3. When the piston 4 ascends to the vicinity of the top dead point, the air-fuel mixture fed into the combustion chamber 7 in the previous stroke gets ignited and explodes. As the piston 4 begins to descend, the pressure inside the crankcase 3 begins to rise. Meanwhile, as the exhaust port 5*a* and the scavenging port 8*a* open, the combustion gas in the combustion chamber 7 begins to be exhausted through the exhaust passage 5 and the air from the scavenging passage 8 is injected into the combustion chamber 7 by the pressure of the crankcase 3, thereby exhausting the remaining combustion gas. Then, following the air, the air-fuel mixture inside the crankcase 3 is introduced into the combustion chamber 7 via the scavenging passage 8 as the piston 4 reaches the bottom dead point. The crank shaft 12 is linked via a connecting rod 10 and a crank arm 11 to the piston 4, which is linearly reciprocated by the repetition of the above cycles, and rotates in exactly the same manner as in a conventional two-cycle engine.

Figure 2:
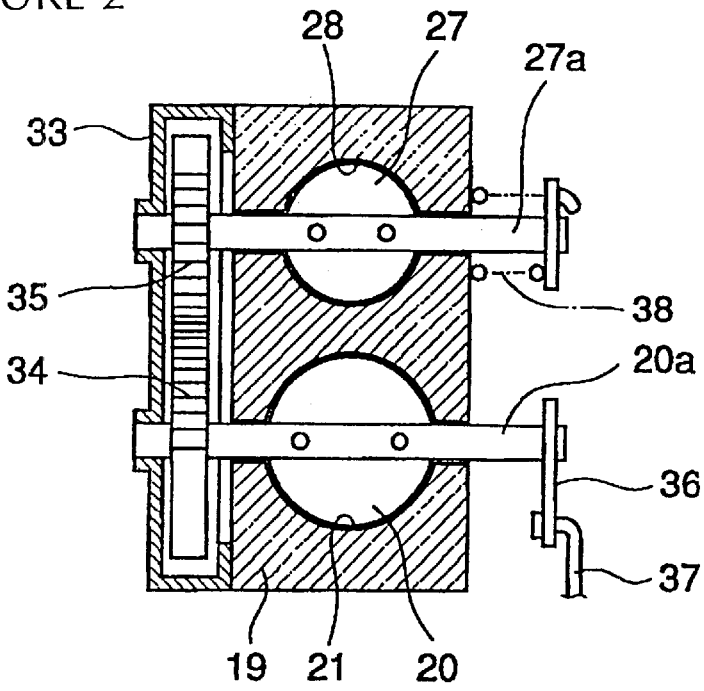
FIG. 2 is an enlarged cross section taken along line A–A of FIG. 1.
Figure 3:
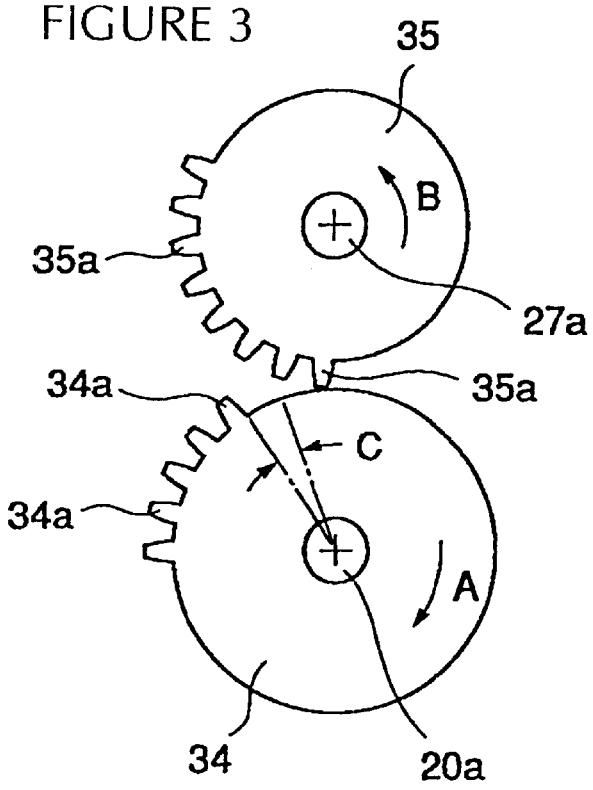
FIG. 3 is a plan view showing the gears of the first embodiment shown in FIG. 1.

FIGS. 1, 2, and 3 show a first preferred embodiment of the present invention in which the air-fuel mixture passage 6 is formed by an intake passage 18 and throttling valve passage 21 of a diaphragm-type carburetor 13 and by an intake passage 23 which is formed protruding on the outside of crankcase 3. The diaphragm-type carburetor 13, which is widely used for fuel supply in small, general-purpose engines, typically sucks out a predetermined amount of fuel kept inside a fuel chamber 15 by means of a diaphragm 14 through a main nozzle 16 using the negative pressure of a venturi tube 17. The throttling valve passage 21 of a valve body 19 is positioned downstream from the intake passage 18 and is opened and closed by a butterfly throttling valve 20. The crankcase intake passage 23 includes a check valve 22 that is located further downstream from the throttling valve passage 21. The throttling valve 20 is opened or closed by an operator's operation of the accelerator and a return spring (not shown), thereby controlling the output of the engine 1 by increasing or decreasing the flow rate of the air-fuel mixture created by the carburetor 13. Note that the check valve 22 allows the air-fuel mixture flow into the crankcase 3 but prevents the mixture from flowing in the opposite direction.

In addition, an air passage 9 is formed by an intake passage 26 of an intake body 25 having the same length as the carburetor 13. An air valve passage 28, which is located downstream from the intake passage 26 and which is opened and closed by a butterfly air valve 27, is installed on the same valve body 19 in which the throttling valve passage 21 is installed. A scavenge intake passage 30 is formed protruding on the outside of the cylinder 2 and includes a check valve 29 that is located further downstream from the air valve passage 28. The air valve 27 is opened and closed in conjunction with the throttling valve 20 by means of a gear mechanism described below, thereby controlling the flow rate of the air for scavenging. Note that the check valve 29 allows air to flow into the scavenging passage 8 but prevents the air from flowing in the opposite direction. The air-fuel mixture and air passages 6 and 9 are preferably positioned close to each other and in parallel to each other, and their inlets preferably open to a single air cleaner 31.

As shown in FIG. 2, a gear box 33 is installed on one side of the valve body 19. One end of a valve shaft 20*a* of the throttling valve 20 and one end of a valve shaft 27*a* of the air valve 27 protrude into the gear box 33, and are connected to a driving gear 34 and a driven gear 35, respectively. A throttling valve lever 36 is fastened onto the other end of the valve shaft 20*a* of the throttling valve 20, and is engaged to the tip of a transmission wire 37 connected to a trigger operated by the operator. A return spring 38 consisting of a twisted coil spring, which biases the air valve 27 in the valve-closing direction, is engaged to the other end of the valve shaft 27*a* of the air valve 27.

As shown in FIG. 3, the driving gear 34 and the driven gear 35 are preferably spur gears. The number of teeth 34*a* provided on the outer perimeter of the driving gear 34 is preferably smaller than the number of teeth 35*a* provided on the outer perimeter of the driven gear 35. FIG. 3 shows a phase relationship in which the throttling valve 20 is in the idling position, and the forward-most gear 34*a* in the valve-opening rotation direction A of the throttling valve 20 is positioned behind the forward-most gear 35*a* in the valve-opening rotation direction B of the air valve 27, which is placed in the most closed position by return spring 38. More particularly, the driving gear 34 does not have teeth that engage with the driven gear 35 at the start of rotation of the driving gear 34 from the idling position, which would cause the driven gear 35 to simultaneously begin rotating. The opening operation range of the throttling valve 20 before the forward-most teeth 34*a* and 35*a* engage with each other is the idling region C of the driving gear 34. This idling region C is the delay angle of air valve 27.

This idling region C can be arbitrarily set by adjusting the number of teeth of the driving gear 34 and driven gear 35, or the number of missing teeth, or the angles of installation of the gears onto the valve shafts 20*a* and 27*a*. In the initial stage of the accelerated operation in the which throttling valve 20 is rapidly opened from the idling position, the flow rate of the air-fuel mixture increases in the slightly open region that is set by idling region C while the air flow rate does not increase. Consequently, by supplying an air-fuel mixture of the required concentration in the initial stage of acceleration, engine revolution can be increased without acceleration failure. When the engine reaches the revolution range in which it can run stably even with a lean air-fuel mixture, the driving gear 34 engages with the driven gear 35 to begin opening the air valve 27 and thereafter tends to keep both the flow rate ratio between the air-fuel mixture and the air, and the air-fuel ratio of the air-fuel mixture to be ignited and exploded in the combustion chamber 7 nearly constant.

In the preferred embodiment shown in FIG. 3, the air valve 27 is designed to open fully when the throttling valve 20 opens fully. In order to increase the opening of the air valve 27, which begins to open later than the throttling valve 20, the pitch circle of the driven gear 35 has a smaller diameter than that of driving gear 34. According to this embodiment in which the air-fuel ratio control system is configured using gears, the throttling valve opening position at which to start the introduction of air can be set as desired. Additionally, the configuration in FIG. 2 in which both gears 34 and 35 are housed inside the gear box 23 installed on one side of the valve body 19 does not require a large space and proper air-fuel ratio control can be performed by installing it in a location that poses no risk of interference with other parts.

Note that although the driving gear 34 and the driven gear 35 are designed to directly engage with each other, it is also possible to provide an intermediate gear, depending on the installation distance between the throttling valve 20 and the air valve 27. Moreover, although the gears are shown as spur gears, it is also possible to use sector gears that have teeth 34*a* and 35*a* necessary for engagement on the pitch circles. Furthermore, in an engine that has multiple scavenging passages 8, it is possible to form the air passage 9 from the scavenge intake passage 30 into multiple branches and connect these to individual scavenging passages 8, or to provide independent air passages 9 and to simultaneously open and close the valve shafts 27*a* of the air valves 27 for the individual air passages 9 as a single common shaft. Additionally, the air valve 27 does not have to be a butterfly valve as long as it is a type that rotates to control flow rate.

Figure 5:
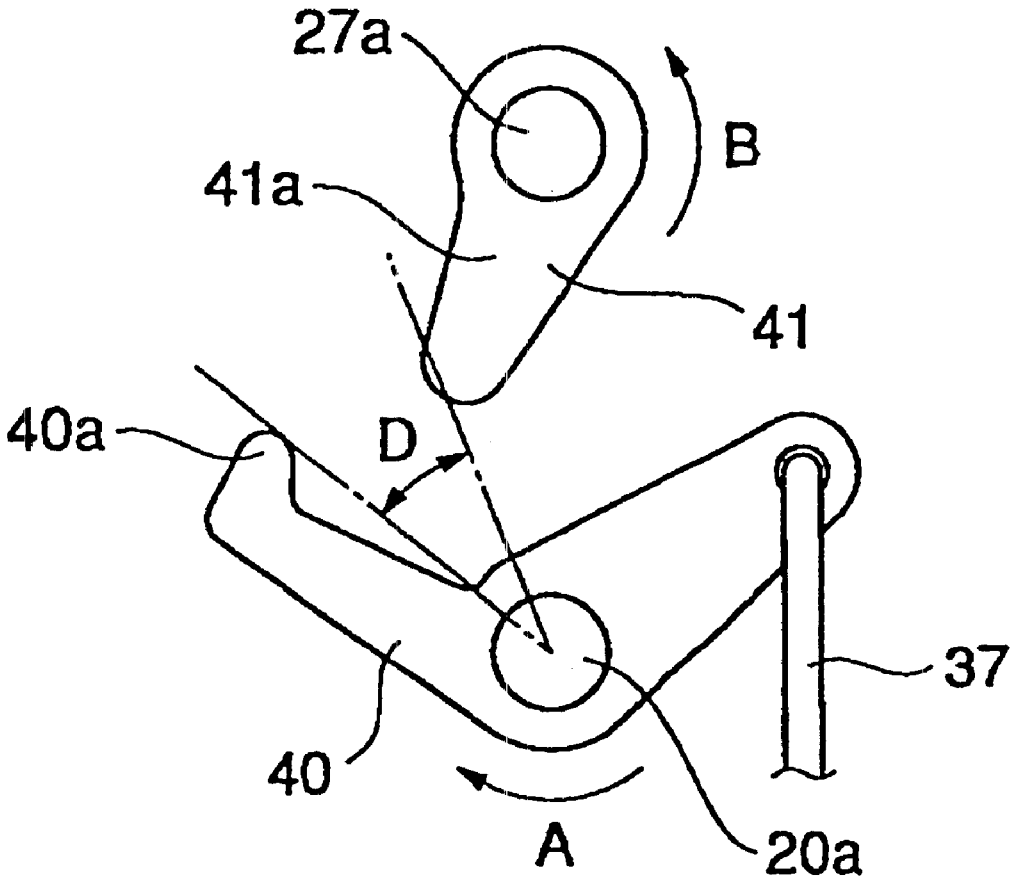
FIG. 5 is a plan view showing the levers of the second embodiment shown in FIG. 4.

Turning to FIGS. 4 and 5, these figures show a second preferred embodiment of the present invention. As shown in FIG. 4, an air-fuel mixture passage 6 is formed by a carburetor intake passage 18 and a crankcase intake passage 23. The carburetor intake passage 18 is provided with a venturi tube 17 and a butterfly throttling valve 20 of a carburetor 13, in which, like the carburetor in FIG. 1, a predetermined amount of fuel kept inside the fuel chamber 15 by means of diaphragm 14 is sucked out through a main nozzle 16 using the negative pressure of the venturi tube 17. The crankcase intake passage 23, which protrudes on the outside of the crankcase 3, includes a check valve 22 which is located downstream from the carburetor intake passage 18. In addition, an air passage 9 is formed by an inlet passage 26 having the same length as the carburetor intake passage 18 and containing butterfly air valve 27; and by a scavenge intake passage 30 which protrudes toward the outside of cylinder 2. The scavenge intake passage 30 includes a check valve 29 that is located further downstream from the intake passage 26. The air-fuel mixture and air passages 6 and 9 are preferably positioned close to each other and in parallel to one another. The carburetor intake passage 18 and inlet passage 26 are preferably formed on the same venting body 32, with their inlets open to a single air cleaner 31.

Preferably, one end of a valve shaft 20*a* of the throttling valve 20 and one end of a valve shaft 27*a* of the air valve 27 protrude toward the outside of the venting body 32. A driving lever 40 and a driven lever 41, respectively, are connected to these protruding ends, as shown in FIG. 5. The driving lever 40 is engaged to the tip of a transmission wire 37 connected to a trigger operated by the operator and acts as a throttling valve lever for opening and closing the throttling valve 20. The driven lever 41 has a receiving edge 41*a* which contacts a pressing piece 40*a* comprising a circular arc-shaped protrusion formed at the tip of the driving lever 40. A return spring (not shown) comprising a twisted coil spring, is applied to the valve shaft 27*a* of the air valve 27 to bias it in the valve-closing direction.

FIG. 5 shows a phase relationship between the driving lever 40 and the driven lever 41 when the throttling valve 20 is in the idling position. The pressing piece 40*a*, which is facing forward in the valve-opening rotation direction A of the throttling valve 20, is positioned behind and away from the receiving edge 41*a*, which is facing the opposite direction from the valve-opening rotation direction B of the air valve 27. The air valve is placed in the most closed position by the return spring. Therefore, when the throttling valve 20 begins to open from the idling position, the opening operation range of the throttling valve 20 before the pressing piece 40*a* of the driving lever 40, which rotates with throttling valve 20, contacts and engages with the receiving edge 41*a* of the driven lever 41, is the idling region D of the driving lever 40. This idling region D is the delay angle of the air valve 27.

This idling region D can be freely set by adjusting the shapes of the driving lever 40 and the driven lever 41, especially the shapes of pressing piece 40*a* and receiving edge 41*a*, or the angles of installation of the levers onto valve shafts 20*a* and 27*a*. When the throttling valve 20 is opened from the idling position in the initial stage of accelerated operation, only the flow rate of the air-fuel mixture is increased in order not to cause acceleration failure, and afterwards the air-fuel ratio is controlled to achieve a nearly constant flow rate ratio between the air-fuel mixture and the air, in substantially the same manner as in the first preferred embodiment of the present invention.

The air valve 27 is also designed to open fully when the throttling valve 20 opens fully. In order to increase the opening of the air valve 27, which begins to open later than the throttling valve 20, the lever ratio of the driving lever 40 is set to a greater value than that of the driven lever 41.

Note that in the aforementioned two embodiments, the throttling valve 20 and the air valve 27 are supported by an integrated valve body 19 or venting body 32, and thus positioning is easier and more accurate compared to an alternative in which these valves are supported by separate bodies provided away from each other, and are linked to one another. Moreover, because gears 34 and 35 or levers 40 and 41 can be installed virtually error-free, it is possible to reduce the adverse effects on engine performance caused by errors in their positional relationships.

As explained above, according to the present invention, an extremely simple means, i.e., delaying the engagement of gears or levers that link the throttling valve and the air valve to maintain a nearly constant flow rate ratio between the air-fuel mixture and the air for scavenging, can be used to prevent the dilution of the air-fuel mixture in the initial stage of acceleration, thus achieve excellent acceleration operation.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A system for controlling the intake of an air-fuel mixture, measured by an air-fuel mixture flow rate, and air, measured by an air flow rate, in a combustion chamber of an engine comprising:

an air passage coupled with a combustion chamber of an engine; and an air-fuel mixture passage coupled with the combustion chamber of the engine;

wherein the air is supplied into the combustion chamber via the air passage and the air-fuel mixture is supplied into the combustion chamber via the air-fuel mixture passage; and wherein the air-fuel mixture passage is openable before the air flow passage.

2. The system in claim 1, wherein the air passage and air-fuel mixture passage each comprise a valve.

3. The system in claim 2, wherein the valve of the air-fuel mixture passage and the valve of the air passage are operably coupled with each other in phased relation wherein opening of the valve of the air fuel mixture passage causes the valve of the air passage to open after the valve of the air-fuel mixture passage has opened a predetermined amount.

4. The system in claim 2, wherein a first gear is coupled to the valve of the air-fuel mixture passage and a second gear is coupled to the valve of the air passage.

5. The system in claim 4, wherein the first gear includes a first plurality of teeth formed on the first gear in an orientation that prevents engagement of a second plurality of teeth formed on the second gear until the first gear has rotated a predetermined amount.

6. The system in claim 5 wherein a pitch circle of the second gear is smaller than a pitch circle of the first gear.

7. The system in claim 2, wherein the valve of the air-fuel mixture passage and the valve of the air passage are operably coupled to each other via a driving lever coupled to the valve of the air-fuel mixture passage and a driven lever coupled to the valve of the air passage, wherein the driving lever and the driven lever are in phased relation.

8. An air-fuel ratio control system for an engine having a combustion chamber and an idle revolution region, comprising:

a means for supplying an air-fuel mixture, measured by an air-fuel mixture flow rate, to the combustion chamber; and a means for supplying air, measured by an air flow rate, to the combustion chamber;

wherein the air-fuel mixture flow rate increases before the air flow rate increases when the engine accelerates from the idle revolution region.

9. The system of claim 8, wherein the means for supplying an air-fuel mixture to the combustion chamber is via an air-fuel mixture passage having a valve and the means for supplying air to the combustion chamber is via an air passage having a valve, and further wherein the valve for the air-fuel mixture passage and the valve for the air passage are operably coupled to each other, directly or indirectly, in phased relation.

10. The system of claim 9, wherein the valve for the air-fuel mixture passage and the valve for the air passage are operably coupled to each other via a gear coupled to the valve for the air passage and a gear coupled to the air-fuel mixture passage, wherein the gear for the air passage and the gear for the air-fuel mixture passage are in phased relation.

11. The system of claim 9, wherein the valve for the air-fuel mixture passage and the valve for the air passage are operably coupled to each other via a driving lever coupled to the air-fuel mixture passage and a driven lever coupled to the air passage, wherein the driving lever and driven lever are in phased relation.

12. A method for controlling the intake of an air-fuel mixture, measured by an air-fuel mixture flow rate, and air, measured by an air flow rate, in a combustion chamber of an engine, having an idle revolution region, comprising the steps of:

accelerating the engine from the idle revolution region; and preventing dilution of the air-fuel mixture with excess air when the engine accelerates from the idle revolution region.

13. The method in claim 12, wherein preventing dilution of the air-fuel mixture step comprises the steps of:

supplying the air-fuel mixture into the combustion chamber;

supplying the air into the combustion chamber; and when the engine accelerates from the idle revolution region, increasing the air-fuel mixture flow rate before increasing the air flow rate.

14. An air and air-fuel mixture intake system comprising:

an air intake passage;

an air-fuel mixture intake passage, wherein the air and air-fuel mixture passages are openable and closeable; and a device coupled to the air and air-fuel mixture passages for controlling the opening of the air intake passage in phased relation with the air-fuel mixture passage.

* * * * *